US009109472B2

(12) United States Patent
Araya et al.

(10) Patent No.: US 9,109,472 B2
(45) Date of Patent: Aug. 18, 2015

(54) APPARATUS AND METHOD FOR CONTROLLING VARIABLE VALVE MECHANISM

(75) Inventors: Norihiro Araya, Isesaki (JP); Kenichi Machida, Isesaki (JP)

(73) Assignee: HITACHI AUTOMOTIVE SYSTEMS, LTD., Hitachinaka-shi (JP)

( * ) Notice: Subject to any disclaimer, the term of this patent is extended or adjusted under 35 U.S.C. 154(b) by 389 days.

(21) Appl. No.: 13/617,034

(22) Filed: Sep. 14, 2012

(65) Prior Publication Data

US 2013/0068181 A1 Mar. 21, 2013

(30) Foreign Application Priority Data

Sep. 20, 2011 (JP) ..... 2011-205373
Aug. 9, 2012 (JP) ..... 2012-177065

(51) Int. Cl.

*F02D 41/22* (2006.01)
*F01L 9/04* (2006.01)
*F01L 1/34* (2006.01)
*F01L 1/047* (2006.01)

(52) U.S. Cl.

CPC ..... *F01L 1/34* (2013.01); *F01L 2001/0473* (2013.01); *F01L 2250/04* (2013.01); *F01L 2800/12* (2013.01)

(58) Field of Classification Search

CPC ..... F02D 29/02; F02D 41/221; F01L 1/34; F01L 9/04
USPC ..... 701/102, 105, 107, 114; 123/90.11, 123/90.15–90.17, 198 D, 196 S; 73/114.03, 73/114.13, 114.26, 114.63
See application file for complete search history.

(56) References Cited

U.S. PATENT DOCUMENTS 6,330,869 B1 * 12/2001 Yoshiki et al. ..... 123/90.15
8,677,959 B2 * 3/2014 Urushihata ..... 123/90.17
2002/0166524 A1 * 11/2002 Nakamura et al. ..... 123/90.16
2006/0106527 A1 * 5/2006 Miyakoshi et al. ..... 701/114
2006/0169232 A1 * 8/2006 Dosdall et al. ..... 123/90.16
2007/0163525 A1 * 7/2007 Fuwa et al. ..... 123/90.16

(Continued)

FOREIGN PATENT DOCUMENTS

JP 2002-54410 2/2002
JP 2009-144521 7/2009

OTHER PUBLICATIONS

JP 2002-054410 English Translation.*

(Continued)

*Primary Examiner* — John Kwon
*Assistant Examiner* — Johnny H Hoang
(74) *Attorney, Agent, or Firm* — Foley & Lardner LLP

(57) ABSTRACT

An control apparatus for a variable valve mechanism, is capable of executing fail safe control in a case in which locking occurs in either one of a cam shaft of a double shaft structure. The control apparatus for a variable valve mechanism has a cam shaft of a double shaft structure including an outer cam shaft and an inner cam shaft, such that it is possible to adjust the phase of a sub cam of inner cam shaft with respect to an main cam of outer cam shaft, and by means these cams, at least one of an intake valve and an exhaust valve of an internal combustion engine is operated. When an abnormality is detected in one of the cam shafts, the control apparatus controls the phase of the cam of the other cam shaft, in accordance with the determined current phase of the cam.

15 Claims, 26 Drawing Sheets

(56) References Cited

U.S. PATENT DOCUMENTS

| | | | | |
|---|---|---|---|---|
| 2007/0251477 | A1* | 11/2007 | Nozawa et al. | 123/90.17 |
| 2009/0143963 | A1* | 6/2009 | Hendriksma | 701/114 |
| 2010/0077979 | A1* | 4/2010 | Takada et al. | 123/90.16 |
| 2010/0145592 | A1* | 6/2010 | Yoo | 701/102 |
| 2011/0100312 | A1* | 5/2011 | Hirata | 123/90.17 |
| 2011/0132327 | A1* | 6/2011 | Aso et al. | 123/436 |

OTHER PUBLICATIONS

JP 2009-144521 English Translation.*

* cited by examiner

Fig.6

| | Abnormal event | Occurred phenomenon | | Fail measure | Remark |
|---|---|---|---|---|---|
| | | Valve | Engine | | |
| a 1 | Intake: device driven in advancing direction is locked on advanced angle side | O/L large | Unstable combustion (engine stall may occur) | Reduce O/L | If first valve is locked on retarded angle side with a device in which first valve and second valve are both driven in the retarding direction on exhaust side CIC, fail measure is not performed as it does not exhibit effect. |
| a 2 | Exhaust: device driven in retarding direction is locked on retarded angle side | | | | |
| b 1 | Intake: device driven in advancing direction is locked on retarded angle side | O/L insufficient | Fuel economy and exhaust deteriorated | Increase O/L | If first valve is locked on advanced angle side with a device in which first valve is driven in the retarding direction and second valve is driven in the advancing direction on exhaust side CIC, fail measure is not performed as it does not exhibit effect. |
| b 2 | Exhaust: device driven in retarding direction is locked on advanced angle side | | | | |
| c | Intake: device driven in retarding direction is locked on advanced angle side | IVC delayed closure not possible | Fuel economy deteriorate | Retard IVC | If first valve is locked on advanced angle side with a device in which first valve is driven in the retarding direction and second valve is driven in the advancing direction on intake side CIC, fail measure is not performed as it does not exhibit effect. |
| d 1 | Intake: device driven in retarding direction is locked on retarded angle side | IVC delayed closure always | Output reduced | Advance IVC | |
| d 2 | Exhaust: device driven in advancing direction is locked on advanced angle side | EVO early opening | | Retard EVO | |
| e | Exhaust: device driven in advancing direction is locked on retarded angle side | EVO early opening not possible | Influence small | Fail measure not required | |

Fig.7A

| CIC cam operating method | | | System object | | | Main-fail | Sub-fail | Impact of failure | | | | |
|---|---|---|---|---|---|---|---|---|---|---|---|---|
| Int/ Exh | Fr-Valve | Rr-Valve | Valve Open | Event | ValveClose | | | Valve Open | Event | Valve Close | Engine state example | |
| Int. | Adv. | Adv. | Extremely increase O/L | Increase operating angle | Early closure | Advanced angle locking | | Excessively advanced | | Excessively advanced | Unstable combustion at time of idling due to large O/L | A1 |
| | | | | | | Retarded angle locking | | Cannot be advanced | | Insufficiently advanced (early closure not possible) | Insufficient O/L | A2 |
| | | | | | | | Advanced angle locking | Excessively advanced | Operating angle excessive | | Unstable combustion at time of idling due to large O/L | A3 |
| | | | | | | | Retarded angle locking | Insufficiently advanced | Operating angle cannot be increased | | Insufficient O/L | A4 |

Fig.7B

| CIC cam operating method | | | System object | | | Main-fail | Sub-fail | Impact of failure | | | | |
|---|---|---|---|---|---|---|---|---|---|---|---|---|
| Int/ Exh | Fr-Valve | Rr-Valve | Valve Open | Event | Valve Close | | | Valve Open | Event | Valve Close | Engine state example | |
| Int. | Advance | Retard | Increase O/L | Increase operating angle | Delayed closure | Advanced angle locking | | Excessively advanced | | Excessively advanced | Unstable combustion at time of idling due to large O/L | B1 |
| | | | | | | Retarded angle locking | | Cannot be advanced | | Cannot be advanced | Insufficient O/L | B2 |
| | | | | | | | Advanced angle locking | | Operating angle cannot be increased | Insufficiently advanced (delayed closure not possible) | Delayed closure cannot be performed, and fuel economy deteriorates | B3 |
| | | | | | | | Retarded angle locking | | Operating angle excessive | Excessively retarded | Always delayed closure, insufficient output | B4 |

Fig.7C

| CIC cam operating method | | | System object | | | Main-fail | Sub-fail | Impact of failure | | | | |
|---|---|---|---|---|---|---|---|---|---|---|---|---|
| Int/ Exh | Fr-Valve | Rr-Valve | Valve Open | Event | ValveClose | | | Valve Open | Event | Valve Close | Engine state example | |
| Int. | Retard | Advance | Increase O/L | Increase operating angle | Delayed closure | Advanced angle locking | | Cannot be retarded | | Cannot be retarded | Delayed closure cannot be performed, and fuel economy deteriorates | C1 |
| | | | | | | Retarded angle locking | | Excessively retarded | | Excessively retarded | Always delayed closure, insufficient output | C2 |
| | | | | | | | Advanced angle locking | Excessively retarded | Operating angle excessive | | Unstable combustion at time of idling due to large O/L | C3 |
| | | | | | | | Retarded angle locking | Insufficiently retarded | Operating angle cannot be increased | | Insufficient O/L | C4 |

Fig.7D

| CIC cam operating method | | | System object | | | Main-fail | Sub-fail | Impact of failure | | | | |
|---|---|---|---|---|---|---|---|---|---|---|---|---|
| Int/ Exh | Fr-Valve | Rr-Valve | Valve Open | Event | ValveClose | | | Valve Open | Event | Valve Close | Engine state example | |
| Int. | Retard | Retard | Delay opening | Increase operating angle | Extremely delayed closure | Advanced angle locking | | Cannot be retarded | | Cannot be retarded | Delayed closure cannot be performed, and fuel economy deteriorates | D1 |
| | | | | | | Retarded angle locking | | Excessively retarded | | Excessively retarded | Always delayed closure, insufficient output | D2 |
| | | | | | | | Advanced angle locking | | Operating angle cannot be increased | Insufficiently retarded | Delayed closure cannot be performed, and fuel economy deteriorates | D3 |
| | | | | | | | Retarded angle locking | | Operating angle excessive | Excessively retarded | Always delayed closure, insufficient output | D4 |

Fig.7E

| CIC cam operating method | | | System object | | | Main-fail | Sub-fail | Impact of failure | | | | |
|---|---|---|---|---|---|---|---|---|---|---|---|---|
| Int/ Exh | Fr-Valve | Rr-Valve | ValveOpen | Event | ValveClose | | | Valve Open | Event | Valve Close | Engine state example | |
| Exh. | Advance | Advance | Extremely early opening | Increase operating angle | O/L small | Advanced angle locking | | Excessively advanced | | Excessively advanced | Exhaust valve opens during expansion stroke, combustion pressure reduced | E1 |
| | | | | | | Retarded angle locking | | Cannot be advanced | | Cannot be advanced | Extremely early opening cannot be performed | E2 |
| | | | | | | | Advanced angle locking | Excessively advanced | Operating angle excessive | | Exhaust valve opens during expansion stroke, combustion pressure reduced | E3 |
| | | | | | | | Retarded angle locking | Insufficiently advanced | Operating angle cannot be increased | | Extremely early opening cannot be performed | E4 |

Fig.7F

| CIC cam operating method | | | System object | | | Main-fail | Sub-fail | Impact of failure | | | | |
|---|---|---|---|---|---|---|---|---|---|---|---|---|
| Int/ Exh | Fr-Valve | Rr-Valve | ValveOpen | Event | ValveClose | | | Valve Open | Event | Valve Close | Engine state example | |
| Exh. | Advance | Retard | Early opening | Increase operating angle | Increase O/L | Advanced angle locking | | Excessively advanced | | Excessively advanced | Exhaust valve opens during expansion stroke, combustion pressure reduced | F1 |
| | | | | | | Retarded angle locking | | Cannot be advanced | | Cannot be advanced | Early opening cannot be performed, operating angle small | F2 |
| | | | | | | | Advanced angle locking | Insufficiently retarded | Operating angle cannot be increased | Insufficiently retarded | Insufficient O/L | F3 |
| | | | | | | | Retarded angle locking | Excessively retarded | Operating angle excessive | Excessively advanced | Unstable combustion at time of idling due to large O/L | F4 |

Fig.7G

| CIC cam operating method | | | System object | | | Main-fail | Sub-fail | Impact of failure | | | | |
|---|---|---|---|---|---|---|---|---|---|---|---|---|
| Int/ Exh | Fr-Valve | Rr-Valve | ValveOpen | Event | ValveClose | | | Valve Open | Event | Valve Close | Engine state example | |
| Exh. | Retard | Advance | Early opening | Increase operating angle | Increase O/L | Advanced angle locking | | Cannot be retarded | | Cannot be retarded | Insufficient O/L | G1 |
| | | | | | | Retarded angle locking | | Excessively retarded | | Excessively retarded | Unstable combustion at time of idling due to large O/L | G2 |
| | | | | | | | Advanced angle locking | Excessively advanced | Operating angle excessive | Excessively retarded | Exhaust valve opens during expansion stroke, combustion pressure reduced | G3 |
| | | | | | | | Retarded angle locking | Insufficiently advanced | Operating angle cannot be increased | Insufficiently advanced | Early opening cannot be performed, operating angle small | G4 |

Fig.7H

| CIC cam operating method | | | System object | | | Main-fail | Sub-fail | Impact of failure | | | | |
|---|---|---|---|---|---|---|---|---|---|---|---|---|
| Int/ Exh | Fr-Valve | Rr-Valve | ValveOpen | Event | ValveClose | | | Valve Open | Event | Valve Close | Engine state example | |
| Exh. | Retard | Retard | Delayed opening | Increase operating angle | Extremely increase O/L | Advanced angle locking | | Cannot be retarded | | Cannot be retarded | Insufficient O/L | H1 |
| | | | | | | Retarded angle locking | | Excessively retarded | | Excessively retarded | Unstable combustion at time of idling due to large O/L | H2 |
| | | | | | | | Advanced angle locking | Insufficiently retarded | Operating angle cannot be increased | Insufficiently retarded | Insufficient O/L | H3 |
| | | | | | | | Retarded angle locking | Excessively retarded | Operating angle excessive | Excessively retarded | Unstable combustion at time of idling due to large O/L | H4 |

Fig.8A

| CIC cam operating method | | | System object | | | Fail measure | Fail measure object | Degree of movement | Action | |
|---|---|---|---|---|---|---|---|---|---|---|
| Int/ Exh | Fr-Valve | Rr-Valve | ValveOpen | Event | ValveClose | | | | | |
| Intake | Advance | Advance | Extremely increase O/L | Increase operating angle | Early closure | Retard second valve timing | Reduce O/L (prevent engine stall) | Retard most | Second valve timing is retarded to delay IVO, and O/L section is reduced. | A1 |
| | | | | | | Advance second valve timing | Increase O/L | According to amount of O/L shortage | Second valve timing is advanced to increase O/L. | A2 |
| | | | | | | Retard first valve timing | Reduce O/L (prevent engine stall) | To a degree so that IVO does not overlap | Overall valve phase shifts to retarded angle side if first valve timing is retarded, and therefore O/L is reduced. | A3 |
| | | | | | | Advance first valve timing | Increase O/L | According to amount of O/L shortage | Overall valve phase shifts to advanced angle side if first valve timing is advanced, and therefore O/L is increased. | A4 |

Fig.8B

| CIC cam operating method | | | System object | | | Fail measure | Fail measure object | Degree of movement | Action | |
|---|---|---|---|---|---|---|---|---|---|---|
| Int/ Exh | Fr-Valve | Rr-Valve | ValveOpen | Event | ValveClose | | | | | |
| Intake | Advance | Retard | Increase O/L | Increase operating angle | Delayed closure | Retard second valve timing | Reduce O/L (prevent engine stall) | To a degree so that second cam IVO does not overlap | Second valve timing is retarded to reduce open valve area at time of O/L. | B1 |
| | | | | | | Advance second valve timing | Increase O/L | According to amount of O/L shortage | Second cam is brought to most advanced angle (phase difference 0) to **gain greater** open area in O/L range. | B2 |
| | | | | | | Retard first valve timing | Delay IVC | According to target IVC | First valve timing is retarded to retard overall valve phase and delay IVC. | B3 |
| | | | | | | Advance first valve timing | Early IVC | According to target IVC | First valve timing advanced to advance overall valve phase and accelerate IVC. | B4 |

Fig.8C

| CIC cam operating method | | | System object | | | Fail measure | Fail measure object | Degree of movement | Action | |
|---|---|---|---|---|---|---|---|---|---|---|
| Int/ Exh | Fr-Valve | Rr-Valve | ValveOpen | Event | ValveClose | | | | | |
| Intake | Retard | Advance | Increase O/L | Increase operating angle | Delayed closure | | | | | C1 |
| | | | | | | Advance second valve timing | Early IVC | Optimum control (set second cam IVC for F/S) | IVC is locked due to locking on first valve timing retarded angle side. Second valve timing is advanced to reduce open valve area in vicinity of actual IVC. | C2 |
| | | | | | | Retard first valve timing | Reduce O/L (prevent engine stall) | To a degree so that IVO does not overlap | Overall valve phase shifts if first valve timing is retarded, and therefore O/L can be reduced. | C3 |
| | | | | | | Advance first valve timing | Increase O/L | According to amount of O/L shortage | Overall valve phase shifts to advanced angle side if first valve timing is advanced, and therefore O/L is increased. | C4 |

Fig.8D

| CIC cam operating method | | | System object | | | Fail measure | Fail measure object | Degree of movement | Action | |
|---|---|---|---|---|---|---|---|---|---|---|
| Int/ Exh | Fr-Valve | Rr-Valve | ValveOpen | Event | ValveClose | | | | | |
| Intake | Retard | Retard | Delay opening | Increase operating angle | Extremely delayed closure | Retard second valve timing | Delay IVC | According to target IVC | Second valve timing is retarded to delay IVC. | D1 |
| | | | | | | Advance second valve timing | Early IVC | According to target IVC | Second valve timing is advanced and retarded angle side operating angle is reduced to accelerate IVC. | D2 |
| | | | | | | Retard first valve timing | Delay IVC | According to target IVC | Overall valve phase shifts to retarded angle side if first valve timing is retarded, and therefore IVC can be delayed. | D3 |
| | | | | | | Retard second valve timing | Early IVC | According to target IVC | Overall valve phase shifts to advanced angle side if first valve timing is advanced and therefore IVC can be accelerated. | D4 |

Fig.8E

| CIC cam operating method | | | System object | | | Fail measure | Fail measure object | Degree of movement | Action | |
|---|---|---|---|---|---|---|---|---|---|---|
| Int/ Exh | Fr-Valve | Rr-Valve | ValveOpen | Event | ValveClose | | | | | |
| Exhaust | Advance | Advance | Extremely early opening | Increase operating angle | O/L small | Advance second valve timing | Delay EVO | According to target EVO | Operating angle becomes smaller if second valve timing is retarded, and EVO is delayed. | E1 |
| | | | | | | | | | | E2 |
| | | | | | | Retard first valve timing | Delay EVO | According to target EVO | Overall valve phase shifts if first valve timing is retarded, and therefore EVO is delayed. | E3 |
| | | | | | | | | | | E4 |

Fig.8F

| CIC cam operating method | | | System object | | | Fail measure | Fail measure object | Degree of movement | Action | |
|---|---|---|---|---|---|---|---|---|---|---|
| Int/ Exh | Fr-Valve | Rr-Valve | ValveOpen | Event | ValveClose | | | | | |
| Exhaust | Advance | Retard | Early opening | Increase operating angle | Increase O/L | Retard second valve timing | Delay EVO | Optimum control | EVO is locked due to locking on first valve timing advanced angle side. Second valve timing is retarded to reduce open valve area in vicinity of actual EVO. | F1 |
| | | | | | | | | | | F2 |
| | | | | | | Retard first valve timing | Increase O/L | According to amount of O/L shortage | Overall valve phase is retarded if first valve timing is retarded, and therefore O/L is increased. | F3 |
| | | | | | | Advance first valve timing | Reduce O/L (prevent engine stall) | To a degree so that EVC does not overlap | Overall valve phase is advanced if first valve timing is advanced, and O/L is reduced. | F4 |

Fig.8G

| CIC cam operating method | | | System object | | | Fail measure | Fail measure object | Degree of movement | Action | |
|---|---|---|---|---|---|---|---|---|---|---|
| Int/ Exh | Fr-Valve | Rr-Valve | ValveOpen | Event | ValveClose | | | | | |
| Exhaust | Retard | Advance | Early opening | Increase operating angle | Increase O/L | | | | | G1 |
| | | | | | | Advance second valve timing | Reduce O/L (prevent engine stall) | To a degree so that second cam EVC does not overlap | Second valve timing is advanced to reduce open valve area at time of O/L. | G2 |
| | | | | | | Retard first valve timing | Delay EVO | According to target EVO | Overall valve phase is retarded if first valve timing is retarded, and EVO is delayed. | G3 |
| | | | | | | | | | | G4 |

Fig.8H

| CIC cam operating method | | | System object | | | Fail measure | Fail measure object | Degree of movement | Action | |
|---|---|---|---|---|---|---|---|---|---|---|
| Int/ Exh | Fr-Valve | Rr-Valve | ValveOpen | Event | ValveClose | | | | | |
| Exhaust | Retard | Retard | Delayed opening | Increase operating angle | Extremely increase O/L | Retard second valve timing | Increase O/L | According to amount of O/L shortage | Second valve timing is retarded, and O/L is increased. | H1 |
| | | | | | | | | | | H2 |
| | | | | | | Retard first valve timing | Increase O/L | According to amount of O/L shortage | Overall valve phase is retarded if first valve timing is retarded, and therefore O/L is increased. | H3 |
| | | | | | | Advance first valve timing | Reduce O/L (prevent engine stall) | To a degree so that EVC does not overlap | Overall valve phase is advanced if first valve timing is advanced, and O/L is reduced. | H4 |

APPARATUS AND METHOD FOR CONTROLLING VARIABLE VALVE MECHANISM

BACKGROUND OF THE INVENTION

1. Field of the Invention

The present invention relates to phase control in a variable valve mechanism of an internal combustion engine.

2. Description of the Related Art

A variable valve mechanism in which a cam shaft that operates an intake valve and an exhaust valve provided for each cylinder, is of a double shaft structure with an outer cam shaft on the outer side and an inner cam shaft on the inner side arranged within this outer cam shaft, and a main cam is attached to the outer cam shaft while a sub cam is attached to the inner cam shaft, is known from the disclosure of Japanese Laid-open (Kokai) Patent Publication Application No. 2002-054410 (Patent Document 1) and Japanese Laid-open (Kokai) Patent Publication Application No. 2009-144521 (Patent Document 2). This type of variable valve mechanism is provided on either one or both of an intake valve and an exhaust valve, and the phase of a cam is appropriately changed to thereby variably control the operating timing from the valve open timing to the valve closed timing.

Normally, the outer cam shaft in a variable valve mechanism determines the phase of the cam with respect to the crank shaft angle, and the inner cam shaft adjusts the phase of the sub cam with respect to the main cam to determine phase shift between the sub cam and the main cam. By controlling the phase of the main cam and the sub cam in this manner, the valve open timing and the valve close timing are each advanced or retarded, thereby enabling variable control of the length of an open period from the open timing to the close timing (operating angle).

As described above, in a variable valve mechanism that performs phase control of the main cam and the sub cam with a cam shaft of a double shaft structure, in a case in which a locking (seizing) defect occurs in either one of the outer cam shaft and the inner cam shaft, efficient operation of the internal combustion engine may be influenced in some cases. That is to say, for example in a variable valve mechanism provided for an intake valve, if the outer cam shaft of the main cam is locked at an advanced angle position, the overlapping between the exhaust valve and the intake valve (a period in which both of the valves stay open) is maintained great. As a result, there is a possibility that a phenomenon of increasing residual gas at the time of idle operation may occur, leading to an undesirable situation such as unstable combustion.

In view of the above points, it is an object of the present invention to provide an apparatus and a method for controlling a variable valve mechanism in an internal combustion engine, that is capable of executing fail safe control in a case in which locking occurs in either one of the cam shafts.

In order to achieve the above object, the apparatus (method) for controlling a variable valve mechanism in an internal combustion engine according to the present invention is configured as described below.

The variable valve mechanism has a cam shaft of a double shaft structure including an outer side cam shaft and an inner side cam shaft, and a cam is attached to each of these outer and inner cam shafts, such that it is possible to adjust the phase of the cam of one of the cam shafts with respect to the cam of the other cam shaft. By means of a pair of these cams, at least one of a pair of intake valves and a pair of exhaust valves of an internal combustion engine is operated.

The control apparatus (method) includes the following.

a current phase determination section for or step of determining, when an abnormality is detected in one cam shaft of the pair of cam shafts, the current phase of the cam of the abnormal cam shaft; and a phase control section for or step of controlling the phase of the cam of the other cam shaft, in accordance with the determined current phase of the one cam.

The other objects and features of this invention will become understood from the following description with reference to the accompanying drawing.

BRIEF DESCRIPTION OF THE DRAWINGS

FIG. 6 is a list showing a summary of an example of control in the case in which locking has occurred in either one of the cam shafts.

FIG. 7 is a list showing details of an example of control in the case in which locking has occurred in either one of the cam shafts.

FIG. 8 is a list that follows FIG. 7.

DESCRIPTION OF THE PREFERRED EMBODIMENTS

Figure 1:
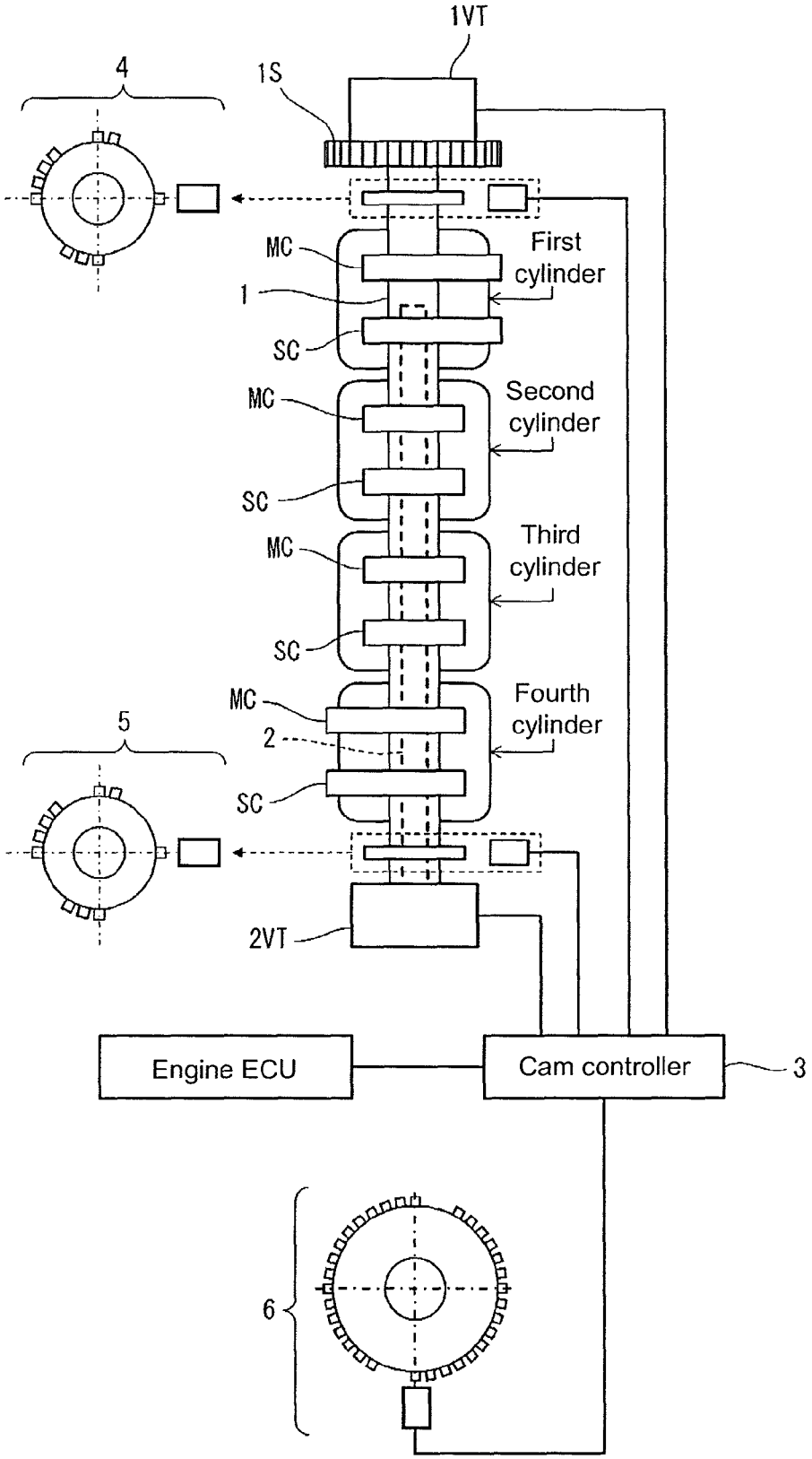
FIG. 1 is a schematic diagram showing an embodiment of a variable valve mechanism and a control apparatus.

FIG. 1 shows, as an embodiment, a variable valve mechanism provided on the intake valve side of a DOHC type four-cylinder engine, and a control apparatus thereof. In the case of the present embodiment, on the exhaust valve side there is no variable valve mechanism such as that provided on the intake valve side. However, a similar variable valve mechanism may be provided on the exhaust valve side only, or on both the intake and exhaust valve sides.

The variable valve mechanism of the present embodiment has a cam shaft of a double shaft structure having a cylindrical outer cam shaft 1 on the outer side, and an inner cam shaft 2 on the inner side that is inserted into the interior of outer cam shaft 1.

Outer cam shaft 1 rotates in synchronization with a crank shaft (not shown in the figure) through a timing belt via a sprocket 1S. A main cam MC is attached to this outer cam shaft 1 so as to correspond to each of first to fourth cylinders, to operate a first intake valve (not shown in the figure) for each cylinder.

The rotational phase of this main cam MC is controlled to the advanced angle side or the retarded angle side by a first valve timing setting section 1VT provided on the end section of outer cam shaft 1.

Inner cam shaft 2 is arranged in the interior of outer cam shaft 1 so as to be able to rotate relatively thereto, and rotates together with outer cam shaft 1. A sub cam SC is attached to this inner cam shaft 2 so as to correspond to each of the first to fourth cylinders, to operate a second intake valve (not shown in the figure) for each cylinder.

The rotational phase of sub cam SC is adjusted relatively with respect to main cam MC by a second valve timing setting section 2VT provided on the end section of inner cam shaft 2.

In this manner, in the variable valve mechanism, outer cam shaft 1 determines the phase (base phase) of main cam MC and sub cam SC with respect to the crank shaft angle, and inner cam shaft 2 adjusts the relative phase of sub cam SC with respect to main cam MC to determine the phase shift therebetween.

As disclosed Patent Documents 1 and 2 mentioned above, the detailed structure of the first valve timing setting section 1VT and the second valve timing setting section 2VT that execute this type of phase control, is commonly known technology.

The first valve timing setting section 1VT and the second valve timing setting section 2VT are controlled by a cam controller 3. Cam controller 3, which is configured with a microcomputer and the like, is illustrated in the figure as a separate device to an engine ECU (electronic control unit). However, it may be integrated into the same chip as the engine ECU, or it may be incorporated as a partial function of the engine ECU.

Cam controller 3 receives inputs of output signals from a commonly known cam sensor 4 of a magnetic type or optical type that detects the rotational state of outer cam shaft 1, and from a similar cam sensor 5 that detects the rotational state of inner cam shaft 2.

Moreover, it also receives an input of an output signal from a commonly known crank sensor 6 provided on the crank shaft. Further, operating state related information such as engine revolution speed, load, and engine temperature (cooling water temperature) are received from the engine ECU, and based on these inputs, the first valve timing setting section 1VT and the second valve timing setting section 2VT are controlled.

FIG. 2 shows outer cam shaft 1 and inner cam shaft 2, which are controlled by the first valve timing setting section 1VT and the second valve timing setting section 2VT, and main cam MC and sub cam SC, which are relatively phase-adjusted by rotating these cam shafts.

In outer cam shaft 1, at the position of sub cam SC, there is formed a through hole 1*a* that is oblong in the circumferential direction, and inner cam shaft 2 and sub cam SC are connected via this through hole 1*a*. That is to say, sub cam SC is slidably fitted on the circumference of outer cam shaft 1, and is connected to inner cam shaft 2 via a connection pin 2*a* provided within the through hole 1*a*.

Figure 2A:
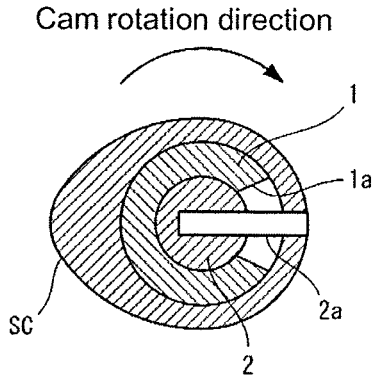
FIG. 2 is a sectional view showing an embodiment of a cam shaft of a double shaft structure.

Therefore, it is possible to adjust the relative phase of sub cam SC with respect to main cam MC in the movable range of the connection pin 2*a* in the through hole 1*a* which is oblong in the circumferential direction. As shown in FIG. 2A, the state in which main cam MC and sub cam SC are completely overlapping is taken as a reference position where the cam profiles of both of the cams match with each other.

Figure 2B:
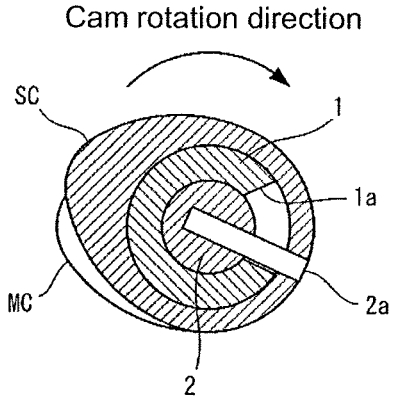

FIG. 2B shows a state of a phase shift where sub cam SC is at the most advanced angle position. The intake valve at this time is brought into an intake valve open timing (IVO) conforming to sub cam SC, and is brought into an intake valve close timing (IVC) conforming to main cam MC, thereby providing a maximum operating angle.

Figure 2C:
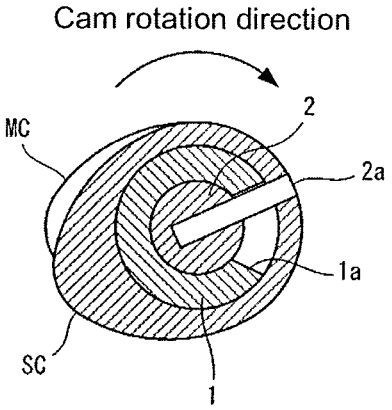

FIG. 2C shows a state of a phase shift where sub cam SC is at the most retarded angle position. The intake valve at this time is brought into an IVO conforming to main cam MC, and is brought into an IVC conforming to sub cam SC, thereby providing the maximum operating angle in this case also.

Regarding the operating timing of the intake valve conforming to main cam MC and sub cam SC controlled in this way by cam controller 3, examples thereof together with the operating timing of the exhaust valve are shown in FIG. 3.

What FIG. 3 shows is cam phases at the time of normal control to be performed based on the operating state information provided from the engine ECU. The exhaust valve is driven by a valve mechanism that is capable of adjusting only the cam phase with respect to the crank shaft angle.

Figure 3A:
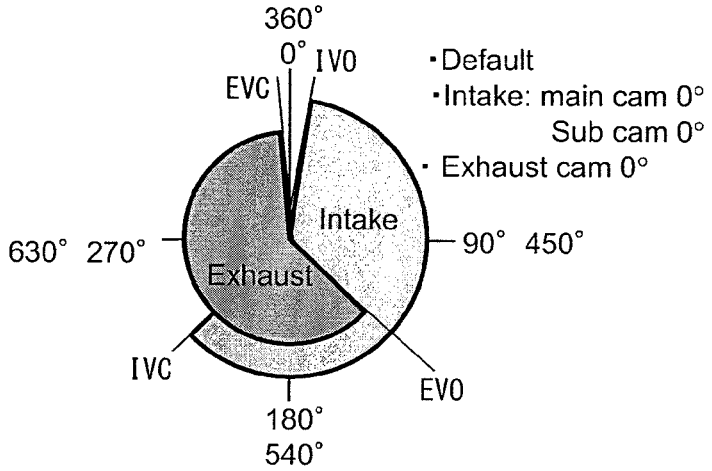
FIG. 3 is a timing chart for describing an example related to the cam phase at the time of normal control according to an operating condition.

FIG. 3A shows a default state where main cam MC is controlled at the reference phase (0°) with respect to the crank shaft angle, and at the same time sub cam SC is adjusted at the reference position (0°) with respect to main cam MC. Furthermore, the cam of the exhaust valve is also controlled at the reference phase. In the figure, reference symbol IVO denotes intake valve open timing, reference symbol IVC denotes intake valve close timing, reference symbol EVO denotes exhaust valve open timing, and reference symbol EVC denotes exhaust valve close timing.

In the case of FIG. 3A, the cam phase is controlled so that the exhaust valve is brought to the EVC before the top dead center and the intake valve is brought to the IVO after the top dead center, and the timing is set in a manner such that no overlapping (O/L) of the intake and exhaust valves is present.

Figure 3B:
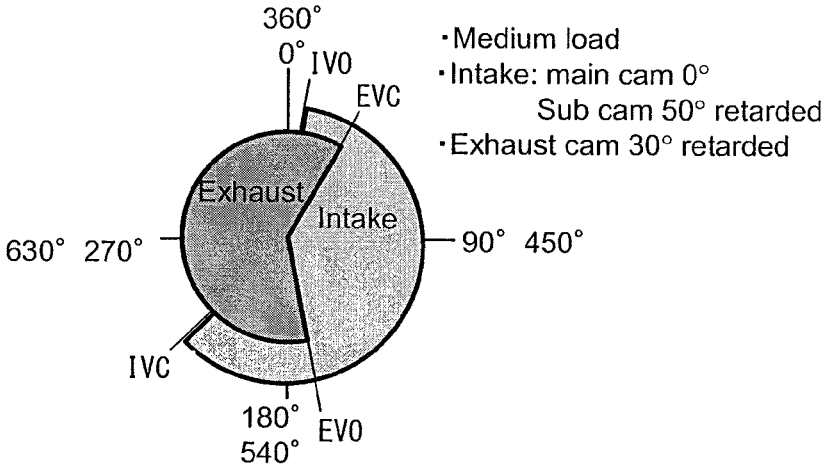

FIG. 3B shows normal control at the time of a medium load. Sub cam SC is adjusted to a retarded angle (50°) while the reference phase (0°) of main cam MC is being maintained (base phase with respect to the crank angle is not changed), thereby having only the IVC of the intake valve set to delayed closure.

Further, by having the exhaust valve controlled to a retarded angle (30°), EVO is set to delayed open and EVC is set to delayed closure. As a result, there is set a timing where O/L of the intake and exhaust valves is present after the top dead center.

Figure 3C:
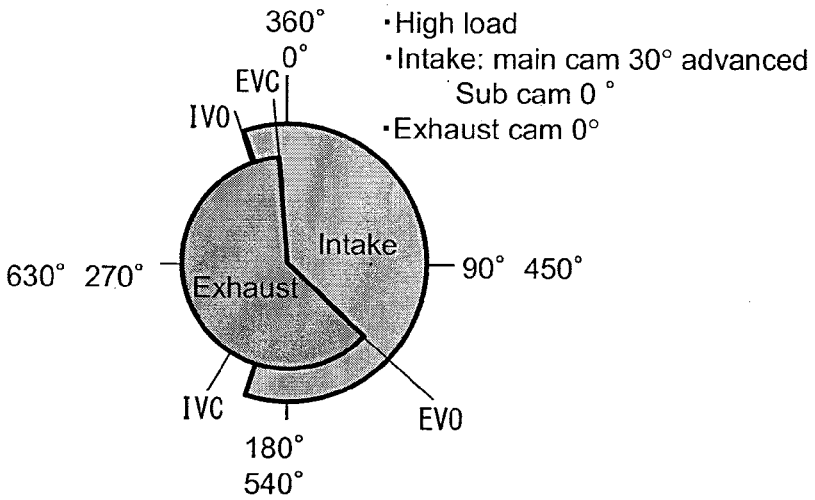

FIG. 3C shows normal control at the time of high load. Main cam MC is controlled to an advanced angle (30°) (base phase with respect to the crank angle is changed) while sub cam SC is maintained at the reference position (0°), thereby setting the IVO of the intake valve to early open.

By having the exhaust valve maintained at the reference phase (0°), there is set a timing where O/L of the intake and exhaust valves is present before the top dead center.

FIG. 4 shows an example of control of the base phase and the relative phase of main cam MC and sub cam SC.

Figure 4A:
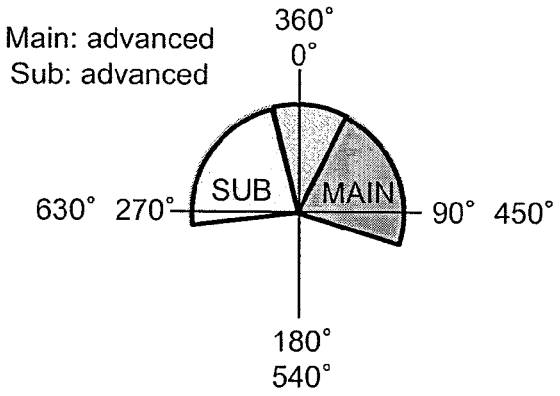
FIG. 4 is a timing chart for describing an example of phase control of a main cam and a sub cam in a variable valve mechanism that is provided for an intake valve.

FIG. 4A shows a case in which main cam MC is controlled to an advanced angle position while sub cam SC is adjusted to an advanced angle position, and extremely early opening and early closure of the intake valve are executed.

Figure 4B:
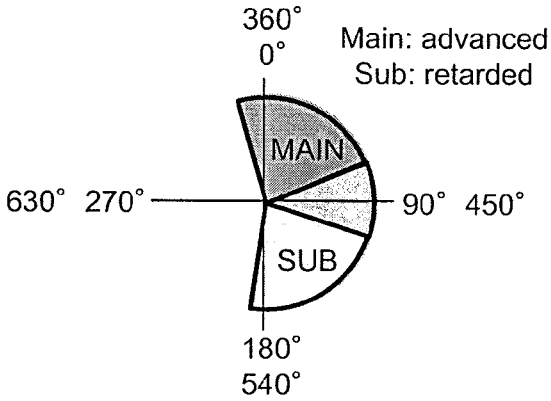

FIG. 4B shows a case in which main cam MC is controlled to an advanced angle position while sub cam SC is adjusted to a retarded angle position, and early opening and an operating angle increment of the intake valve are executed.

Figure 4C:
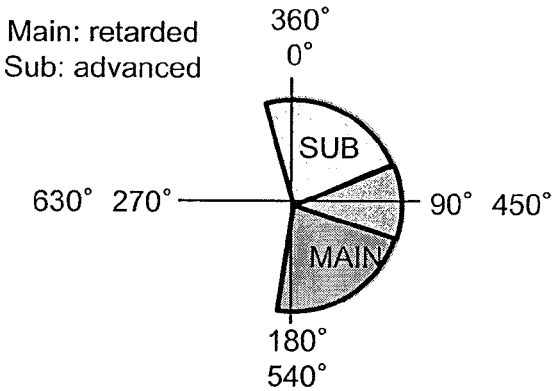

FIG. 4C shows a case in which main cam MC is controlled to a retarded angle position while sub cam SC is adjusted to an advanced angle position, and early opening and an operating angle increment of the intake valve are executed.

Figure 4D:
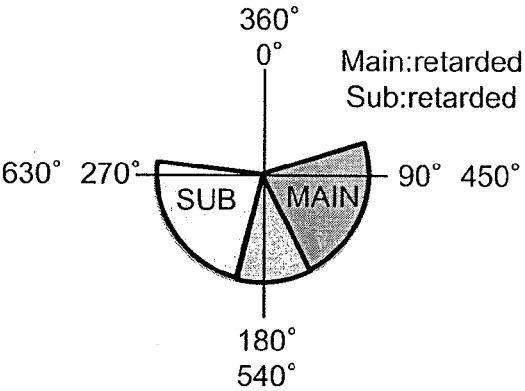

FIG. 4D shows a case in which main cam MC is controlled to a retarded angle position while sub cam SC is adjusted to a retarded angle position, and delayed opening and extremely delayed closure of the intake valve are executed.

FIG. 5 shows an example of control of base phase and relative phase of main cam MC and sub cam SC in a case in which the variable valve mechanism is provided for the exhaust valve.

Figure 5A:
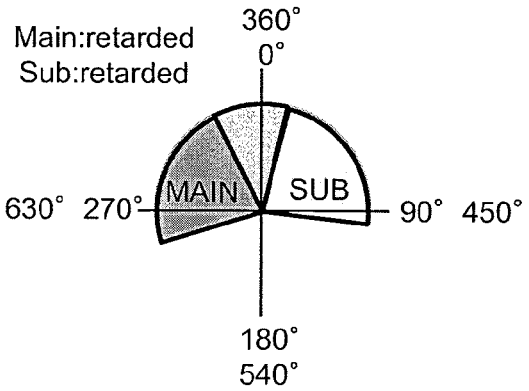
FIG. 5 is a timing chart for describing an example of phase control of a main cam and a sub cam in a variable valve mechanism that is provided for an exhaust valve.

FIG. 5A shows a case in which main cam MC is controlled to a retarded angle position while sub cam SC is adjusted to a retarded angle position, and delayed opening and extremely delayed closure of the exhaust valve are executed.

Figure 5B:
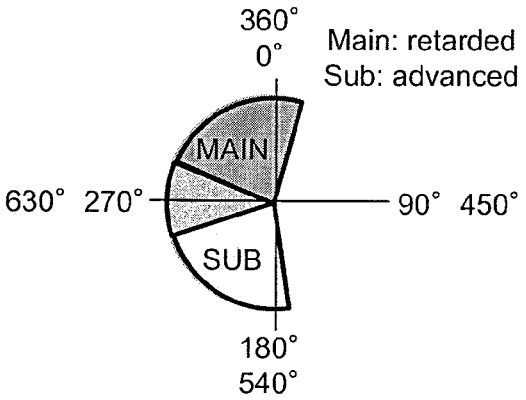

FIG. 5B shows a case in which main cam MC is controlled to a retarded angle position while sub cam SC is adjusted to an advanced angle position, and delayed opening and an operating angle increment of the exhaust valve are executed.

Figure 5C:
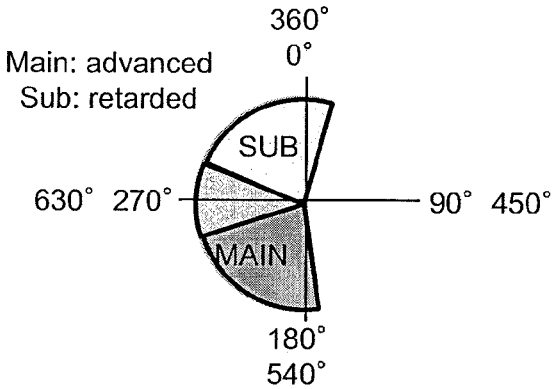

FIG. 5C shows a case in which main cam MC is controlled to an advanced angle position while sub cam SC is adjusted to a retarded angle position, and delayed closure and an operating angle increment of the exhaust valve are executed.

Figure 5D:
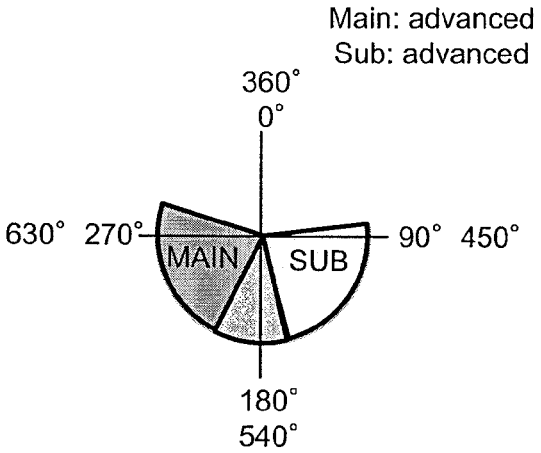

FIG. 5D shows a case in which main cam MC is controlled to an advanced angle position while sub cam SC is adjusted to an advanced angle position, and extremely early opening and early closure of the exhaust valve are executed.

FIG. 6 relates to phase control of main cam MC and sub cam SC shown in FIG. 4 and FIG. 5, and shows a list of; various types of abnormal events that may occur in the system (locking of the cam shaft), occurrence phenomenon of each event (state of valve and engine state), and a summary of fail measures for each event.

FIG. 6 also shows a case in which a variable valve mechanism similar to that of the intake side is provided on the exhaust side. In the figure, the variable valve mechanism on outer cam shaft 1 (main cam MC) side is shown as a first variable valve mechanism, and the variable valve mechanism on the sub cam shaft 2 (sub cam SC) side is shown as a second variable valve mechanism.

a1 shows a case in which when at least one of outer cam shaft 1 and inner cam shaft 2 is controlled to an advanced angle position with a pair of variable valve mechanisms on the intake side configured as described above, a locking defect has occurred at an advanced angle side position, to the variable valve mechanism that performs this control (A1, A3, B1, and C3 of FIG. 7 and FIG. 8 described later).

a2 shows a case in which when at least one of outer cam shaft 1 and inner cam shaft 2 is controlled to a retarded angle position with a pair of variable valve mechanisms on the exhaust side configured in a manner similar to that of the intake side, a locking defect has occurred at a retarded angle side position, to the variable valve mechanism that performs this control (F4, G2, H2, and H4 of FIG. 7 and FIG. 8).

In these cases, depending on the engine operating state, O/L becomes excessive where the intake valve open timing IVO is excessively advanced with a1 or the exhaust valve close timing EVC is excessively retarded with a2. As a result, combustion at the time of idle operation may become unstable, consequently resulting in engine stall.

Consequently, as a fail-safe measure for this case, the other variable valve mechanism that is not locked is driven in the direction of reducing O/L.

However, in the case of a2, when the first variable valve mechanism (outer cam shaft 1) and the second variable valve mechanism (inner cam shaft 2) are both controlled to a retarded angle position, if outer cam shaft 1 is locked on the retarded angle side, O/L cannot be sufficiently reduced or eliminated even if the fail-safe measure is employed in which inner cam shaft 2 is advanced from the position of being driven to retard together with outer cam shaft 1, and the effect of O/L reduction cannot be obtained. As a result, this fail-safe measure will not be executed (H2 of FIG. 7 and FIG. 8).

b1 shows a case in which when at least one of outer cam shaft 1 and inner cam shaft 2 is controlled to an advanced angle position with a pair of variable valve mechanisms on the intake side, a locking defect has occurred at a retarded angle side position, to the variable valve mechanism that performs this control (A2, A4, B2, and C4 of FIG. 7 and FIG. 8).

b2 shows a case in which when at least one of outer cam shaft 1 and inner cam shaft 2 is controlled to a retarded angle position with a pair of variable valve mechanisms on the exhaust side, a locking defect has occurred at an advanced angle side position, to the variable valve mechanism that performs this control (F3, G1, H1, and H3 of FIG. 7 and FIG. 8).

In these cases, with b1, the open timing IVO of the intake valve on the locking side is retarded, and with b2, the close timing EVC of the exhaust valve on the locking side is retarded. As a result, in both of these cases, O/L is reduced, and hence fuel economy and exhaust emission are deteriorated.

Consequently, as a fail-safe measure for these cases, the other variable valve mechanism that is not locked is driven in the direction of increasing O/L.

However, in the case of b2, when the first variable valve mechanism (outer cam shaft 1) is controlled to a retarded angle position and the second variable valve mechanism (inner cam shaft 2) is controlled to an advanced angle position, if outer cam shaft 1 is locked at an advanced angle side position, O/L cannot be sufficiently increased even if the fail-safe measure is employed, in which inner cam shaft 2 is advanced from the position of being driven to retard, together with outer cam shaft 1, and the effect of O/L increment cannot be obtained. As a result, this fail-safe measure will not be executed (G1 of FIG. 7 and FIG. 8).

c shows a case in which when a delayed closure control is performed with a pair of variable valve mechanisms on the intake side to retard at least one of outer cam shaft 1 and inner cam shaft 2 and retard the close timing IVC of the intake valve after the bottom dead center, a locking defect has occurred at an advanced angle side position, to the variable valve mechanism that performs this control (B3, C1, D1, and D3 of FIG. 7 and FIG. 8).

In this case, it becomes impossible to perform delayed closure control of the intake valve.

Consequently, as a fail-safe measure for this case, the variable valve mechanism of the other cam shaft that is not locked, is driven so that the phase of the other cam is retarded and delayed closure control of the intake valve becomes possible.

However, when the first variable valve mechanism (outer cam shaft 1) is controlled to the retarded angle side and the second variable valve mechanism (inner cam shaft 2) is controlled to the advanced angle side, if outer cam shaft 1 is locked on the advanced angle side, inner cam shaft 2 cannot be sufficiently retarded even if the fail-safe measure is employed in which inner cam shaft 2 is retarded from the position of being driven to advance, together with outer cam shaft 1, and delayed closure control cannot be performed. As a result, this fail-safe measure will not be executed (C1 of FIG. 7 and FIG. 8).

d1 shows a case in which when at least one of outer cam shaft 1 and inner cam shaft 2 is controlled to a retarded angle position with a pair of variable valve mechanisms on the intake side, a locking defect has occurred at a retarded angle side position, to the variable valve mechanism that performs this control (B4, C2, D2, and D4 of FIG. 7 and FIG. 8).

In this case, delayed closure is always performed, and output cannot be ensured within the operating range in which output needs to be obtained.

d2 shows a case in which when at least one of outer cam shaft 1 and inner cam shaft 2 is controlled to an advanced angle position with a pair of variable valve mechanisms on the exhaust side, a locking defect has occurred at an advanced angle side, to the variable valve mechanism that performs this control (E1, E3, F1, and G3 of FIG. 7 and FIG. 8).

In this case, the open timing EVO of the exhaust valve is always advanced, and as with the case of d1, output cannot be ensured within the operating range where output needs to be obtained.

Consequently, as a fail-safe measure for these cases E1 and E2, the variable valve mechanism of the other cam shaft that is not locked, is driven to advance the close timing IVC of the intake valve with E1 and retard the open timing EVO of the exhaust valve with E2, thereby each ensuring output within the output range.

e shows a case in which when at least one of outer cam shaft 1 and inner cam shaft 2 is controlled to an advanced angle position with a pair of variable valve mechanisms on the exhaust side, a locking defect has occurred at a retarded angle side, to the variable valve mechanism that performs this control (E2, E4 F2, and G4 of FIG. 7 and FIG. 8).

In this case, although it is difficult to advance the open timing EVO of the exhaust valve, the influence thereof is small, and hence no fail-safe measure is required.

Regarding the phase control of main cam MC and sub cam SC shown in FIG. 4 and FIG. 5, in FIG. 7 and the subsequent figure FIG. 8 there is shown a list of objects of advancing/retarding control that the system intends to perform, defects in those cases in which locking occurs in the cam shaft, and details of fail measures thereof. In the figures, Fr-Valve represents the phase of main cam MC, and Rr-Valve represents the phase of sub cam SC.

For example, FIG. 7B and FIG. 8B are referenced regarding the intake valve. The purpose of advance-controlling main cam MC. (Fr-Valve) and retard-controlling sub cam SC (Rr-Valve) at the same time regarding the IVO according to main cam MC is to increase the overlapping (O/L) with the exhaust valve, and regarding the IVC according to sub cam SC, it is to increase the operating angle with delayed closure.

At this time, as shown in the fields indicated with B1 in FIG. 7 and FIG. 8, if outer cam shaft 1 has a locking defect at an advanced angle position and main cam MC has a locking at an advanced angle position (the current phase of the cam of the abnormal cam shaft), O/L becomes excessive due to IVO being excessively advanced, and consequently, combustion instability occurs at the time of idle operation. Furthermore, there is a possibility that it may result in engine stall in some cases.

Consequently, in this case, there is executed a control such that the phase of sub cam SC (the cam of the other cam shaft) is further retarded, and the intake valve opening area during O/L is reduced while keeping the IVO of the second intake valve from overlapping, to thereby reduce O/L. That is to say, the phase of sub cam SC of inner cam shaft 2 is controlled in the direction of suppressing as much as possible any defect that may occur in the operation of the internal combustion engine due to locking of outer cam shaft 1 (so that the operation approximates the operation at optimum efficiency).

Moreover, as shown in the fields shown with B2 in FIG. 7 and FIG. 8, if a locking defect occurs in outer cam shaft 1 at a retarded angle position and main cam MC is locked at a retarded angle position, IVO cannot be advanced, and there may be a situation where O/L becomes insufficient.

Consequently, in this case, there is executed a control for increasing the O/L so that the phase of sub cam SC is advanced and the shortage of the O/L amount is compensated.

Furthermore, as shown in the fields shown with B3 in FIG. 7 and FIG. 8, if a locking defect occurs in inner cam shaft 2 at an advanced angle position and sub cam SC is locked at an advanced angle position, the operating angle cannot be increased and delayed closure cannot be performed, and this may deteriorate fuel economy.

Consequently, in this case, a control for delaying IVC is executed so that the phase of main cam MC is retarded and the target IVC is achieved.

As shown in the fields shown with B4 in FIG. 7 and FIG. 8, if a locking defect occurs in inner cam shaft 2 at a retarded angle position and sub cam SC is locked at a retarded angle position, IVC becomes excessively retarded and the operating angle becomes excessively large, resulting in insufficient output.

Consequently, in this case, a control for advancing IVC is executed so that the phase of main cam MC is advanced and the target IVC is achieved.

Cam controller 3 executes the above-mentioned fail-safe control for currently requested advancing/retarding control shown in FIG. 7 and FIG. 8, according to the flow charts of FIG. 9 to FIG. 12. A program for executing this process flow is stored in the built-in memory of cam controller 3, and cam controller 3 operates as a current phase determination section and a phase control section according to this program, to execute the flow. Each process shown in FIG. 9 to FIG. 12 is repeatedly executed for example every several milliseconds or several μseconds after the engine has started.

Figure 9:
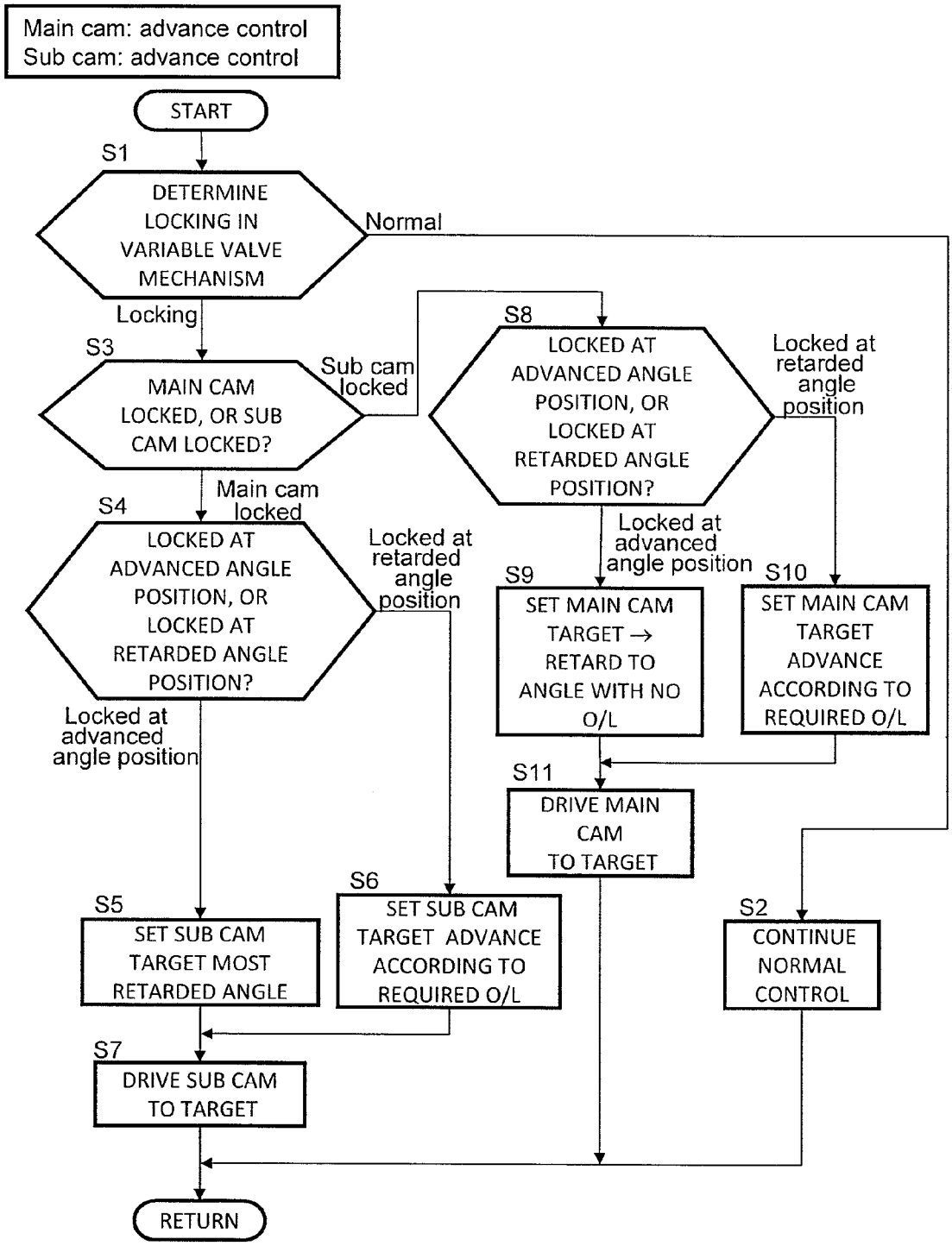
FIG. 9 is a flow chart showing a first example of phase control executed by a control apparatus according to the embodiment.

The flow chart of FIG. 9 is a process that cam controller 3 executes in the event of locking occurring in either one of cam shafts 1 anE2 when the base phase of main cam MC is advance-controlled and the relative phase of sub cam SC is advance-adjusted at the same time according to the operating state information provided by the engine ECU (refer to FIG. 7A and FIG. 8A).

In step S1, cam controller 3 monitors for an abnormality of outer cam shaft 1 and inner cam shaft 2 based on output signals from cam sensors 4 and 5, and crank sensor 6. For example, it monitors whether or not the sensor values from cam sensors 4 and 5 reach the control target within a predetermined period, to determine locking in the variable valve mechanism.

If it is determined as being normal in step S1, the process flow proceeds to step S2 to continue the normal control, and returns and repeats determination of variable valve mechanism locking.

If locking is determined as occurring as a result of step S1, then in step S3, cam controller 3 determines which output signal among those from cam sensors 4 and 5 is abnormal, to thereby determine whether the locking has occurred in outer cam shaft 1 of main cam MC or it has occurred in inner cam shaft 2 of sub cam SC.

If the locking is on the main cam MC side, cam controller 3, in step S4, determines whether main cam MC is locked at an advanced angle position or at a retarded angle position, based on the output signal from cam sensor 4.

If the locking has occurred at an advanced angle position (field shown with A1 in FIG. 7 and FIG. 8), cam controller 3, in step S5, controls the phase of sub cam SC in accordance with the current phase of main cam MC (advanced angle locking). In this step S5, cam controller 3 sets the control target of sub cam SC to the most retarded angle in order to delay IVO of the second intake valve and reduce O/L.

On the other hand, if the locking has occurred at a retarded angle position (field shown with A2 in FIG. 7 and FIG. 8), cam controller 3, in step S6, in accordance with the current phase of main cam MC (retarded angle locking), sets the control target of sub cam SC to an advanced angle according to the required O/L (shortage of O/L amount) in order to advance IVO of the second intake valve and increase O/L. The "required O/L" at this time can be determined according to the operating state information provided by the engine ECU.

After having set the sub cam target, cam controller 3, in step S7, controls the second valve timing setting section 2VT to drive sub cam SC to the target, and performs monitoring with cam sensor 5. After this, the process flow returns and repeats the process from step S1.

If the locking is on the sub cam SC side in step S3, cam controller 3, in step S8, determines whether sub cam SC is locked at an advanced angle position or at a retarded angle position, based on the output signal from cam sensor 5.

If the locking has occurred at an advanced angle position (field shown with A3 in FIG. 7 and FIG. 8), cam controller 3, in step S9, controls the phase of main cam MC in accordance with the current phase of sub cam SC (advanced angle locking). In this step S9, cam controller 3 sets the control target of main cam MC to a retarded angle to an extent so that at least IVO of the first intake valve does not overlap, in order to delay IVO of the first intake valve and reduce O/L. The "extent to which O/L does not occur" at this time can be determined as IVO=EVC.

On the other hand, if the locking has occurred at a retarded angle position (field shown with A4 in FIG. 7 and FIG. 8), cam controller 3, in step S10, in accordance with the current phase of sub cam SC (retarded angle locking), sets the control target of main cam MC to an advanced angle according to the required O/L (shortage of O/L amount) mentioned above in order to advance IVO of the first intake valve and increase O/L.

After having set the main cam target, cam controller 3, in step S11, controls the first valve timing setting section 1VT to drive main cam MC to the target, and performs monitoring with cam sensor 4. After this, the process flow returns and repeats the process from step S1.

Figure 10:
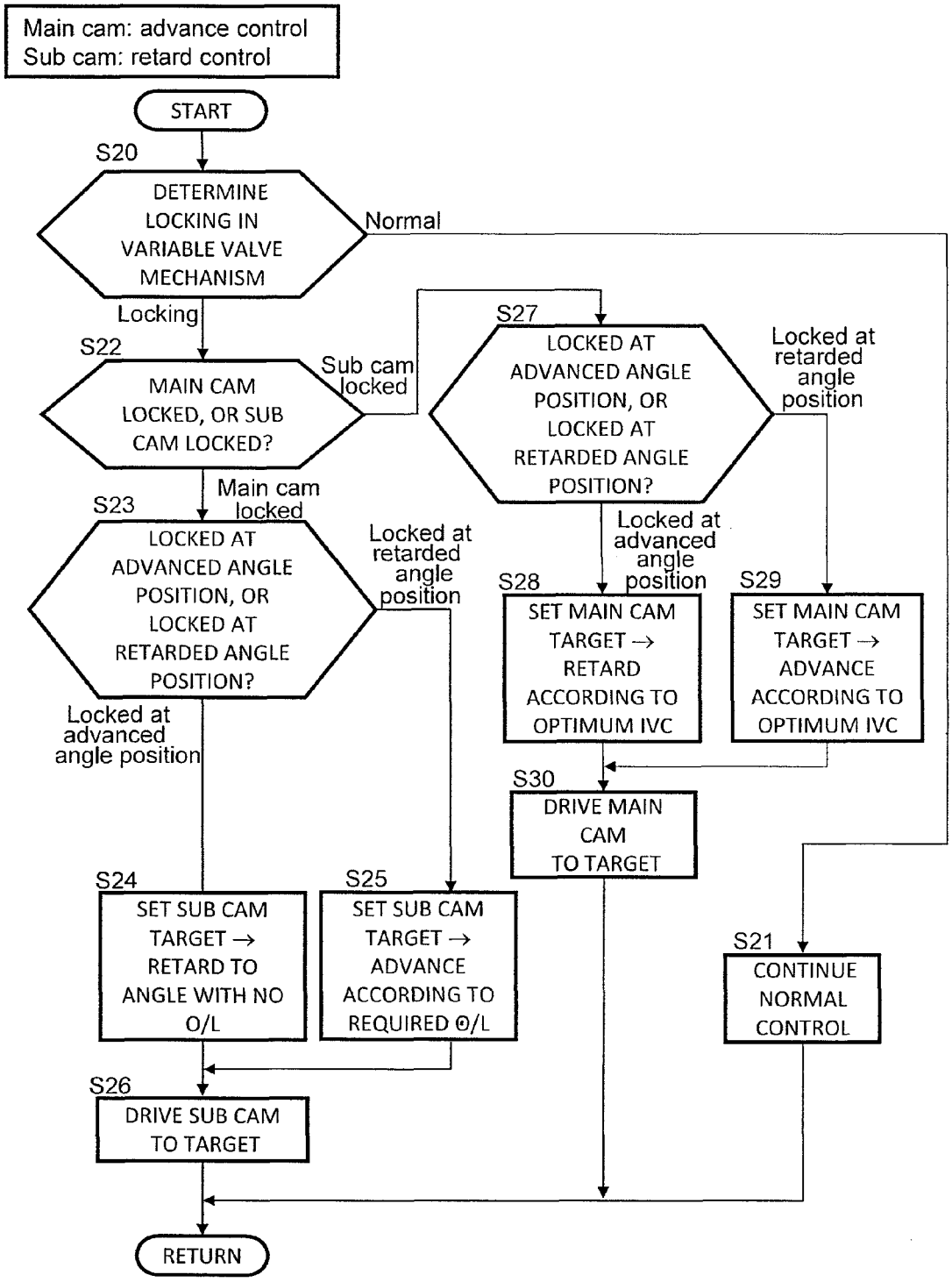
FIG. 10 is a flow chart showing a second example of phase control executed by the control apparatus according to the embodiment.

The flow chart of FIG. 10 is a process that cam controller 3 executes in the event of locking occurring in either one of cam shafts 1 anE2 when the base phase of main cam MC is advance-controlled and the relative phase of sub cam SC is retard-adjusted at the same time according to the operating state information provided by the engine ECU (refer to FIG. 7B and FIG. 8B).

In step S20, as with the description above, cam controller 3 monitors for an abnormality of outer cam shaft 1 and inner cam shaft 2 based on output signals from cam sensors 4 and 5, and crank sensor 6, to determine locking of the variable valve mechanism.

If it is determined as being normal in step S20, the process flow proceeds to step S21 to continue the normal control, and returns and repeats determination of variable valve mechanism locking.

If locking is determined as occurring as a result of step S20, then in step S22, cam controller 3 determines whether the locking has occurred in outer cam shaft 1 of main cam MC or it has occurred in inner cam shaft 2 of sub cam SC, based on the output signals from cam sensors 4 and 5 as with the description above.

If the locking is on the main cam MC side, cam controller 3, in step S23, determines whether main cam MC is locked at an advanced angle position or at a retarded angle position, based on the output signal from cam sensor 4.

If the locking has occurred at an advanced angle position (field shown with B1 in FIG. 7 and FIG. 8), cam controller 3, in step S24, controls the phase of sub cam SC in accordance with the current phase of main cam MC (advanced angle locking). In this step S24, cam controller 3 sets the control target of sub cam SC to a retarded angle to an extent so that IVO of the second intake valve does not overlap, in order to delay IVO of the second intake valve and reduce O/L.

On the other hand, if the locking has occurred at a retarded angle position (field shown with B2 in FIG. 7 and FIG. 8), cam controller 3, in step S25, in accordance with the current phase of main cam MC (retarded angle locking), sets the control target of sub cam SC to an advanced angle according to the required O/L (shortage of O/L amount) in order to advance IVO of the second intake valve and increase O/L.

After having set the sub cam target, cam controller 3, in step S26, controls the second valve timing setting section 2VT to drive sub cam SC to the target, and performs monitoring with cam sensor 5. After this, the process flow returns and repeats the process from step S20.

If the locking is on the sub cam SC side in step S22, cam controller 3, in step S27, determines whether sub cam SC is locked at an advanced angle position or at a retarded angle position, based on the output signal from cam sensor 5.

If the locking has occurred at an advanced angle position (field shown with B3 in FIG. 7 and FIG. 8), cam controller 3, in step S28, controls the phase of main cam MC in accordance with the current phase of sub cam SC (advanced angle locking). In this step S28, cam controller 3 sets the control target of main cam MC to a retarded angle according to an optimum IVC in order to delay IVC of the first intake valve to delay the overall IVC. The "optimum IVC" at this time can be determined according to the operating state information provided by the engine ECU.

On the other hand, if the locking has occurred at a retarded angle position (field shown with B4 in FIG. 7 and FIG. 8), cam controller 3, in step S29, in accordance with the current phase of sub cam SC (retarded angle locking), sets the control target of main cam MC to an advanced angle according to the optimum IVC described above in order to advance IVC of the first intake valve and accelerate the overall IVC.

After having set the main cam target, cam controller 3, in step S30, controls the first valve timing setting section 1VT to drive main cam MC to the target, and performs monitoring with cam sensor 4. After this, the process flow returns and repeats the process from step S20.

Figure 11:
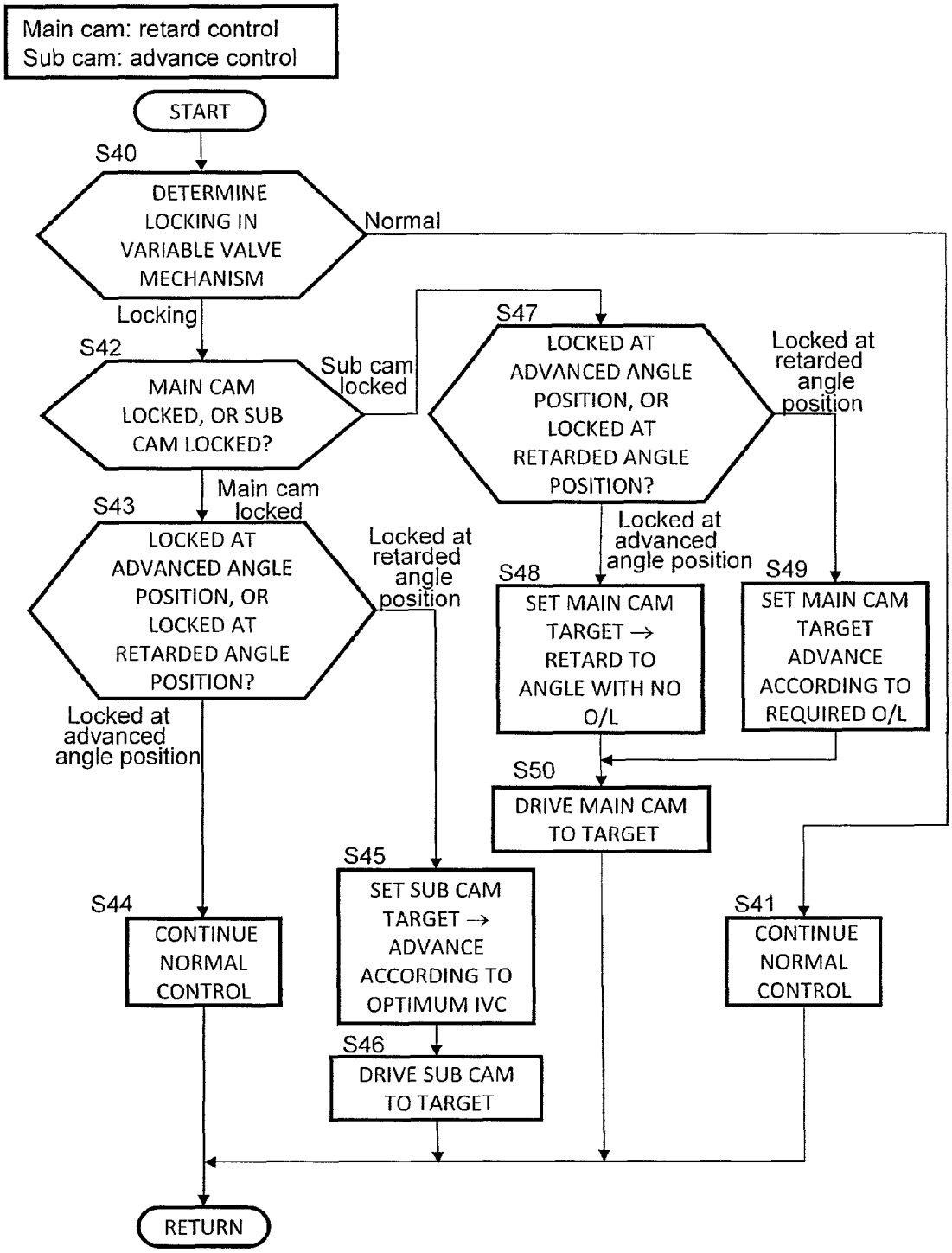
FIG. 11 is a flow chart showing a third example of phase control executed by the control apparatus according to the embodiment.

The flow chart of FIG. 11 is a process that cam controller 3 executes in the event of locking occurring in either one of cam shafts 1 anE2 when the base phase of main cam MC is retard-controlled and the relative phase of sub cam SC is advance-adjusted at the same time according to the operating state information provided by the engine ECU (refer to FIG. 7C and FIG. 8C).

In step S40, as with the description above, cam controller 3 monitors for an abnormality of outer cam shaft 1 and inner cam shaft 2 based on output signals from cam sensors 4 and 5, and crank sensor 6, to determine locking of the variable valve mechanism.

If it is determined as being normal in step S40, the process flow proceeds to step S41 to continue the normal control, and returns and repeats determination of variable valve mechanism locking.

If locking is determined as occurring as a result of step S40, then in step S42, cam controller 3 determines whether the locking has occurred in outer cam shaft 1 of main cam MC or it has occurred in inner cam shaft 2 of sub cam SC, based on the output signals from cam sensors 4 and 5 as with the description above.

If the locking is on the main cam MC side, cam controller 3, in step S43, determines whether main cam MC is locked at an advanced angle position or at a retarded angle position, based on the output signal from cam sensor 4.

If the locking has occurred at an advanced angle position (field shown with C1 in FIG. 7 and FIG. 8), cam controller 3, in step S44, performs no special phase control for sub cam SC and continues to perform the normal control (however, sub cam SC may be controlled to a retarded angle position in this case).

On the other hand, if the locking has occurred at a retarded angle position (field shown with C2 in FIG. 7 and FIG. 8), cam controller 3, in step S45, in accordance with the current phase of main cam MC (retarded angle locking), sets the control target of sub cam SC to an advanced angle according to an optimum IVC in order to advance IVC of the second intake valve to achieve IVC at an optimum timing. The "optimum IVC" at this time can be determined according to a correction value that is calculated based on the difference between the target IVC based on the operating state information provided by the engine ECU, and the current base phase IVC of the locked main cam MC.

If the IVC associated with the locked main cam MC is retarded more fhan the target IVC based on the operating state information, the valve opening area can be reduced by the target IVC and the control can be approximated to the appropriate control, by advancing sub cam SC to the target IVC.

After having set the sub cam target, cam controller 3, in step S46, controls the second valve timing setting section 2VT to drive sub cam SC to the target, and performs monitoring with cam sensor 5. After this, the process flow returns and repeats the process from step S40.

If the locking is on the sub cam SC side in step S42, cam controller 3, in step S47, determines whether sub cam SC is locked at an advanced angle position or at a retarded angle position, based on the output signal from cam sensor 5.

If the locking has occurred at an advanced angle position (field shown with C3 in FIG. 7 and FIG. 8), cam controller 3, in step S48, controls the phase of main cam MC in accordance with the current phase of sub cam SC (advanced angle locking). In this step S48, cam controller 3 sets the control target of main cam MC to a retarded angle to an extent so that at least IVO of the first intake valve does not overlap, in order to delay IVO of the first intake valve and reduce O/L.

On the other hand, if the locking has occurred at a retarded angle position (field shown with C4 in FIG. 7 and FIG. 8), cam controller 3, in step S49, in accordance with the current phase of sub cam SC (retarded angle locking), sets the control target of main cam MC to an advanced angle according to the required O/L (shortage of O/L amount) in order to advance IVO of the first intake valve and increase O/L.

After having set the main cam target, cam controller 3, in step S50, controls the first valve timing setting section 1VT to drive main cam MC to the target, and performs monitoring with cam sensor 4. After this, the process flow returns and repeats the process from step S40.

Figure 12:
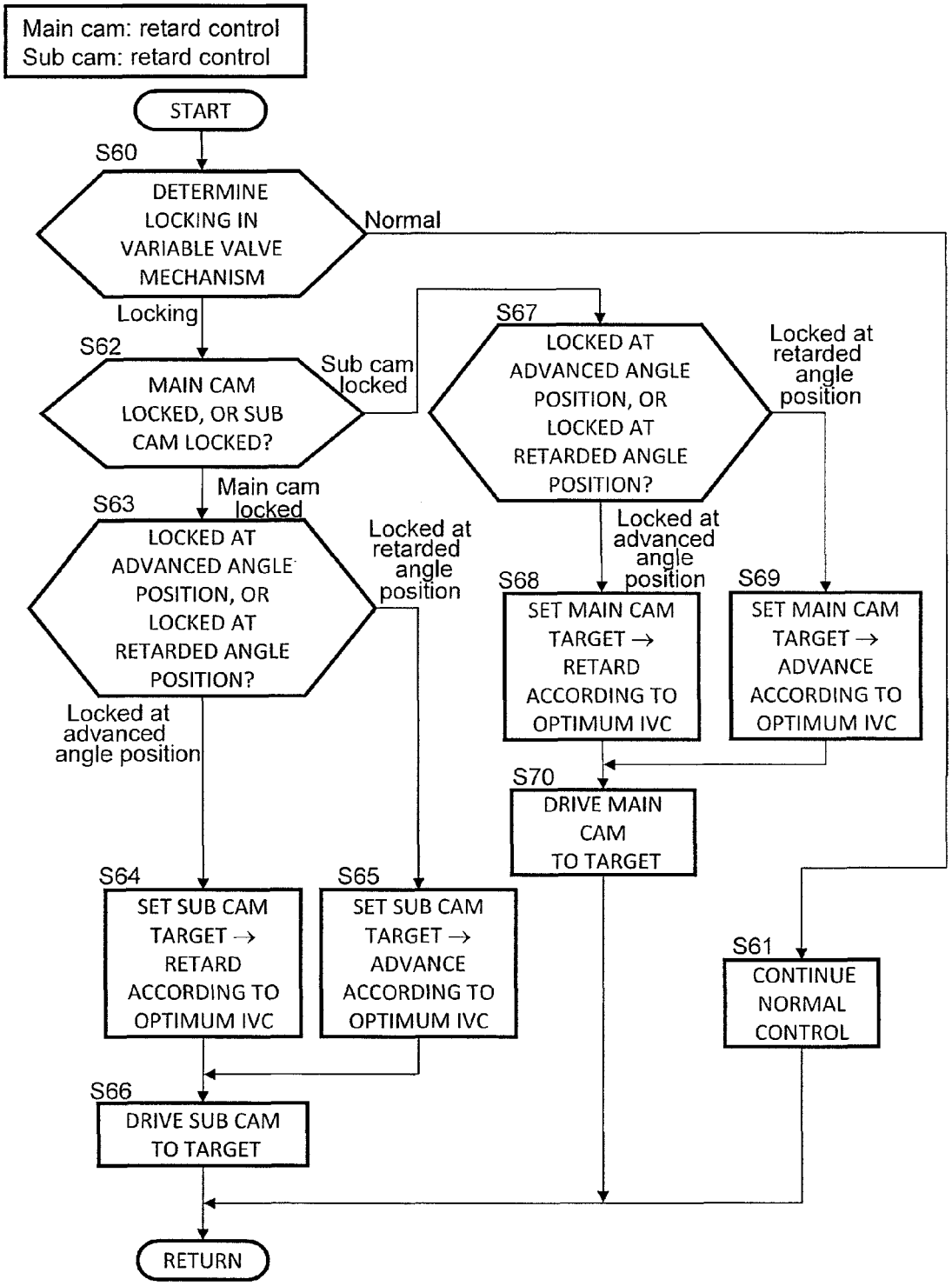
FIG. 12 is a flow chart showing a fourth example of phase control executed by the control apparatus according to the embodiment.

The flow chart of FIG. 12 is a process that cam controller 3 executes in the event of locking occurring in either one of cam shafts 1 and 2 when the base phase of main cam MC is retard-controlled and the relative phase of sub cam SC is retard-adjusted at the same time according to the operating state information provided by the engine ECU (refer to FIG. 7D and FIG. 8D).

In step S60, as with the description above, cam controller 3 monitors for an abnormality of outer cam shaft 1 and inner cam shaft 2 based on output signals from cam sensors 4 and 5, and crank sensor 6, to determine locking of the variable valve mechanism.

If it is determined as being normal in step S60, the process flow proceeds to step S61 to continue the normal control, and returns and repeats determination of variable valve mechanism locking. If locking is determined as occurring as a result of step S60, then in step S62, cam controller 3 determines whether the locking has occurred in outer cam shaft 1 of main cam MC or it has occurred in inner cam shaft 2 of sub cam SC, based on the output signals from cam sensors 4 and 5 as with the description above.

If the locking is on the main cam MC side, cam controller 3, in step S63, determines whether main cam MC is locked at an advanced angle position or at a retarded angle position, based on the output signal from cam sensor 4.

If the locking has occurred at an advanced angle position (field shown with D1 in FIG. 7 and FIG. 8), cam controller 3, in step S64, controls the phase of sub cam SC in accordance with the current phase of main cam MC (advanced angle locking). In this step S64, cam controller 3 sets the control target of sub cam SC to a retarded angle according to an optimum IVC in order to delay the IVC of the second intake valve and to achieve the target IVC according to the operating state.

On the other hand, if the locking has occurred at a retarded angle position (field shown with D2 in FIG. 7 and FIG. 8), cam controller 3, in step S65, in accordance with the current phase of main cam MC (retarded angle locking), sets the control target of sub cam SC to an advanced angle according to an optimum IVC in order to advance IVC of the second intake valve to achieve the target IVC according to the operating state.

After having set the sub cam target, cam controller 3, in step S66, controls the second valve timing setting section 2VT to drive sub cam SC to the target, and performs monitoring with cam sensor 5. After this, the process flow returns and repeats the process from step S60.

If the locking is on the sub cam SC side in step S62, cam controller 3, in step S67, determines whether sub cam SC is locked at an advanced angle position or at a retarded angle position, based on the output signal from cam sensor 5.

If the locking has occurred at an advanced angle position (field shown with D3 in FIG. 7 and FIG. 8), cam controller 3, in step S68, controls the phase of main cam MC in accordance with the current phase of sub cam SC (advanced angle locking). In this step S68, cam controller 3 sets the control target of main cam MC to a retarded angle according to an optimum IVC in order to delay IVC of the first intake valve to delay the overall IVC.

On the other hand, if the locking has occurred at a retarded angle position (field shown with D4 in FIG. 7 and FIG. 8), cam controller 3, in step S69, in accordance with the current phase of sub cam SC (retarded angle locking), sets the control target of main cam MC to an advanced angle according to the optimum IVC described above in order to advance IVC of the first intake valve and accelerate the overall IVC.

After having set the main cam target, cam controller 3, in step S70, controls the first valve timing setting section 1VT to drive main cam MC to the target, and performs monitoring with cam sensor 4. After this, the process flow returns and repeats the process from step S60.

As described above, cam controller 3 is capable of performing fail-safe control of the phase of the other cam that is not locked in the direction of making the O/L period appropriate or in the direction of making IVO or IVC of the intake valve appropriate, in accordance with the current phase of the locked cam.

It can be easily understood that the flow charts of FIG. 9 to FIG. 12 can also be applied to those cases in which the variable valve mechanism is provided on the exhaust valve side, in order to realize appropriate EVO/EVC according to the locking state of the cam shaft.

The entire contents of Japanese Patent Application No. 2011-205373 filed Sep. 20, 2011, and Japanese Patent Application No. 2012-177065 filed Aug. 9, 2012, are incorporated herein by reference.

While only a select embodiment have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention, the invention as claimed in the appended claims and their equivalents.

What is claimed is:

1. An apparatus for controlling a variable valve mechanism in an internal combustion engine, wherein:

the variable valve mechanism has a cam shaft of a double shaft structure including an outer cam shaft and an inner cam shaft, and a cam is attached to each of the outer and inner cam shafts, such that a phase of a cam of one of the cam shafts is adjustable with respect to a cam of the other cam shaft;

the cams are arranged to operate with at least one of a pair of intake valves and a pair of exhaust valves of the internal combustion engine; and the apparatus includes a current phase determination section configured to determine, when an abnormality is detected in one of the cam shafts, a current phase of the one of the cam shafts in which the abnormality is detected, and a phase control section configured to control the phase of the cam of the other cam shaft, in accordance with the determined current phase of the one cam.

2. An apparatus for controlling a variable valve mechanism according to claim 1, wherein:

a phase control of the cam of the other cam shaft in the phase control section is performed to control an overlapping period during which at least one of the intake valves and at least one of the exhaust valves are open.

3. An apparatus for controlling a variable valve mechanism according to claim 1, wherein:

a phase control of the cam of the other cam shaft in the phase control section is performed to control an open or close timing of at least one of the valves.

4. An apparatus for controlling a variable valve mechanism according to claim 2, wherein:

the current phase determination section determines, when locking is detected in one of the cam shafts, whether a current phase of the cam of the locked cam shaft is at an advanced angle position or at a retarded angle position; and the phase control section advances or retards the cam of the other cam shaft in accordance with the determined current phase of the cam, so that the overlapping period of the at least one of the intake valves and the at least one of the exhaust valves is a required period.

5. An apparatus for controlling a variable valve mechanism according to claim 3, wherein:

the current phase determination section determines, when locking is detected in one of the cam shafts, whether a current phase of the cam of the locked cam shaft is at an advanced angle position or at a retarded angle position; and the phase control section advances or retards the cam of the other cam shaft in accordance with the determined current phase of the cam, so that the open or close timing of at least one of the intake valves or at least one of the exhaust valves is a required timing.

6. An apparatus for controlling a variable valve mechanism according to claim 4, wherein:

when the current phase determination section determines that the current phase of the cam of the one locked cam shaft is at an advanced angle position, the phase control section retards the cam of the other cam shaft; and when the current phase determination section determines that the current phase of the cam of the one locked cam shaft is at a retarded angle position, the phase control section advances the cam of the other cam shaft so as to regulate the overlapping period of the at least one intake valve and the at least one exhaust valve.

7. An apparatus for controlling a variable valve mechanism according to claim 5, wherein:

when the current phase determination section determines that the current phase of the cam of the one locked cam shaft is at an advanced angle position, the phase control section retards the cam of the other cam shaft; and when the current phase determination section determines that the current phase of the cam of the one locked cam shaft is at a retarded angle position, the phase control section advances the cam of the other cam shaft so as to regulate the open or close timing of at least one of the intake valves or at least one of the exhaust valves.

8. An apparatus for controlling a variable valve mechanism in an internal combustion engine, the valve mechanism having a double shaft structure including an outer cam shaft and an inner cam shaft, and a cam attached to each of the outer and inner cam shafts, such that a phase of a cam of one of the cam shafts is adjustable with respect to a cam of the other cam shaft; the cams being arranged to operate at least one of a pair of intake valves and a pair of exhaust valves of the internal combustion engine, comprising:

a current phase determination means for determining, when an abnormality is detected in one of the cam shafts, a current phase of the cam of the cam shaft in which the abnormality is detected; and a phase control means for controlling the phase of the cam of the other cam shaft, in accordance with the determined current phase of the one cam.

9. A method for controlling a variable valve mechanism in an internal combustion engine, in which the variable valve mechanism has a cam shaft of a double shaft structure including an outer cam shaft and an inner cam shaft, and a cam is attached to each of the outer and inner cam shafts, such that a phase of a cam of one of the cam shafts is adjustable with respect to a cam of the other cam shaft; and the cams are arranged to operate at least one of a pair of intake valves and a pair of exhaust valves of an internal combustion engine, the method comprising:

determining, when an abnormality is detected in one of the cam shafts, a current phase of the cam of the cam shaft in which the abnormality is detected; and controlling the phase of the cam of the other cam shaft, in accordance with the determined current phase of the one cam.

10. A method for controlling a variable valve mechanism according to claim 9, wherein:

controlling the phase of the cam of the other cam shaft comprises controlling an overlapping period during which at least one of the intake valves and at least one of the exhaust valves are open.

11. A method for controlling a variable valve mechanism according to claim 9, wherein:

controlling the phase of the cam of the other cam shaft comprises controlling an open or close timing of at least one of the valves.

12. A method for controlling a variable valve mechanism according to claim 10, wherein:

determining the current phase of the cam of the cam shaft in which the abnormality is detected comprises determining, when locking is detected in one of the cam shafts, whether a current phase of the cam of the locked cam shaft is at an advanced angle position or at a retarded angle position; and controlling the phase of the cam of the other cam shaft advances or retards the cam of the other cam shaft in accordance with the determined current phase of the cam of the cam shaft in which the abnormality is detected, so that the overlapping period is a required period.

13. A method for controlling a variable valve mechanism according to claim 11, wherein:

determining the current phase of the cam of the cam shaft in which the abnormality is detected comprises determining, when locking is detected in one of the cam shafts, whether a current phase of the cam of the locked cam shaft is at an advanced angle position or at a retarded angle position; and controlling the phase of the cam of the other cam shaft advances or retards the cam of the other cam shaft in accordance with the determined current phase of the cam of the cam shaft in which the abnormality is detected, so that the open or close timing of at least one of the intake valves or the exhaust valves is a required timing.

14. A method for controlling a variable valve mechanism according to claim 12, wherein controlling the phase of the cam of the other cam shaft comprises:

when the current phase of the cam of the one locked cam shaft is determined to be at an advanced angle position, retarding the cam of the other cam shaft; and when the current phase of the cam of the one locked cam shaft is determined to be at a retarded angle position, advancing the cam of the other cam shaft so as to regulate overlapping period.

15. A method for controlling a variable valve mechanism according to claim 13, wherein controlling the phase of the cam of the other cam shaft comprises:

when the current phase of the cam of the one locked cam shaft is determined to be at an advanced angle position, retarding the cam of the other cam shaft; and when the current phase of the cam of the one locked cam shaft is determined to be at a retarded angle position, advancing the cam of the other cam shaft so as to regulate the open or close timing of at least one of the intake valves or at least one of the exhaust valves.

* * * * *